US007150676B2

(12) United States Patent
Meissner

(10) Patent No.: US 7,150,676 B2
(45) Date of Patent: Dec. 19, 2006

(54) DUAL MOTION POLISHING TOOL

(75) Inventor: Stephen C. Meissner, West Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/241,144

(22) Filed: Sep. 11, 2002

(65) Prior Publication Data

US 2004/0048563 A1 Mar. 11, 2004

(51) Int. Cl.
*B24B 49/00* (2006.01)

(52) U.S. Cl. ..... 451/11; 451/121; 451/159; 451/259

(58) Field of Classification Search ..... 451/9, 451/10, 11, 121, 159, 259, 42
See application file for complete search history.

(56) References Cited

U.S. PATENT DOCUMENTS 1,422,505 A 7/1922 Weaver
3,156,073 A 11/1964 Strasbaugh
4,274,232 A 6/1981 Wylde
4,510,717 A * 4/1985 Sherwin
4,768,308 A 9/1988 Atkinson, III et al.
5,085,007 A * 2/1992 Tusinski
6,033,449 A 3/2000 Cooper et al.
6,184,139 B1 2/2001 Adams et al.

* cited by examiner

*Primary Examiner*—Eileen P. Morgan
(74) *Attorney, Agent, or Firm*—Stephen H. Shaw

(57) ABSTRACT

A polishing tool that includes: an arbor with a shank having a first cylindrical axis; an offset cylinder extending from the shank, the offset cylinder having a second cylindrical axis, the first cylindrical axis being offset from the second cylindrical axis and parallel thereto, the offset cylinder terminating at a distal end thereof with a support surface that is angled in a range of from about 1° to about 20° from perpendicular to the first and second cylindrical axes; and a toroidal polishing head supported on the support surface, rotation of the shank causing an oscillating rotational movement of the toroidal polishing head.

3 Claims, 7 Drawing Sheets

DUAL MOTION POLISHING TOOL

FIELD OF THE INVENTION

The invention relates generally to the field of optical manufacturing processes, and in particular to polishing of optical surfaces. More specifically, the invention relates to a high-precision polishing tool for polishing an optical quality surface onto a substrate.

BACKGROUND OF THE INVENTION

In manufacturing of optical components, lenses, molds, and the like, preliminary operations, such as grinding or diamond turning, are performed to generate an optical surface on a raw blank of material. The preliminary operations provide the general form of the component, but leave surface defects that include turning grooves, cutter marks, and sub-surface damage. A final polishing step is required to remove these surface and sub-surface defects. Polishing is accomplished in a variety of ways depending upon the material and the surface's form (i.e.: a surface can have plano, spherical, or aspherical form).

Plano and spherical surfaces are typically polished using "full-aperture" or "full-surface" tools. Full aperture tools tend to cover over 80% of the work piece surface during polishing. Full-aperture tools may be constructed in a variety of ways, including traditional "pitch" and more recent pad-type. "Pitch" polishing tools are comprised of a soft flow-able material, such as pitch or bees wax, which is used to create a mold of the optical surface. Referring to FIG. 1, this mold is a mirror replica of the work piece surface and becomes a polishing tool 300 once the mold is modified with grooves 305. Polishing tool 300 has a support surface 310 and is fixedly attached to a shank 315 that forms an arbor 320 that is used to hold the polishing tool 300 in application. During polishing, polishing tool 300 is held against the work piece (not shown, but conventionally, made of optical glass) with an applied force and the two components are moved relative to one another in the presence of a free abrasive polishing compound, such as cerium oxide, to achieve polishing.

A pad-type full-aperture polishing tool depicted in FIG. 2 consists of a polishing tool 300 incorporated with polishing pad 325 resting or adhered to support surface 310. The polishing pad 325 is typically attached to the support surface 310 via adhesive or via friction grip as disclosed in U.S. Pat. No. 4,274,232 issued to Wylde, on Jun. 23, 1981.

Polishing of aspheric surfaces using full-aperture tools involves much iteration to rebuild or reshape the polishing tool slowing the polishing process considerably. Therefore, polishing of aspheric surfaces is commonly restricted to sub-aperture methods using ring-tools or small-area tools. Sub-aperture methods using ring-tools or small-area tools rely on a polishing tool that contacts less than 50% of the work piece surface at one time. Ring tools, as disclosed in U.S. Pat. No. 4,768,308 issued to Atkinson, III et al. on Sep. 6, 1988, have a diameter that is comparable to or larger than the radius of the work piece and contact the work piece surface over an area that is much larger than that for a small-area tool. Small-area tools contact only a small area of the work surface at a time and create an interfacial contact area that is on the order of 99% smaller than the area of the work piece surface.

Traditionally, manufacturers made polishing tools rotationally symmetric, with minimal radial and axial run-out, such as the full-aperture and sub-aperture polishing tools depicted in U.S. Pat. No. 6,033,449, issued to Cooper et al., on Mar. 7, 2000. Sub-aperture small-area tools may be outfitted with a variety of polishing head shapes, including spherical (as shown in FIG. 3), but may also include conical, cylindrical, and flat along with a polishing pad. In FIG. 3, a sub-aperture polishing tool 330 includes an arbor 335 fixedly attached to a spherical polishing head 340. It should be noted that the spherical polishing head 340 may be substituted with one of the aforementioned polishing heads of a different geometrical shape. Sub-aperture ring-tools may be considered a variation on the small-area tool with the polishing head being of ring-shaped configuration with surface contact during polishing being from 3% to 50% of the work piece surface.

Such rotationally symmetric polishing tools, as described above, require a driving device to impart various motions, for example, rotational and oscillatory motions. However, where the work piece surface has a consistent rotational motion relevant to the rotational polishing tool, unwanted grooves can occur. These unwanted grooves negatively affect the optical properties of the work piece surface, because they prevent the work piece surface from being perfectly smooth.

Driving devices, as noted in U.S. Pat. No. 1,422,505 issued to Weaver on Jul. 11, 1922, and U.S. Pat. No. 3,156,073 issued to Strasbaugh on Nov. 10, 1964, are limited in velocity and subsequent oscillation frequency due to the mass and complexity required to impart such motions. Moreover, these prior art solutions are only applicable to full aperture polishing found in spheres and plano type surfaces and not aspheric surfaces. Consequently, there is a need for a polishing tool that will effectively polish aspheric surfaces.

SUMMARY OF THE INVENTION

The need is met according to the present invention by providing a polishing tool that includes: a) an arbor with a shank having a first cylindrical axis; an offset cylinder extending from the shank, the offset cylinder having a second cylindrical axis, the first cylindrical axis being offset from the second cylindrical axis and parallel thereto, the offset cylinder terminating at a distal end thereof with a support surface that is angled in a range of from about 1° to about 20° from perpendicular to the first and second cylindrical axes; and a toroidal polishing head supported on the support surface, rotation of the shank causing an oscillating rotational movement of the toroidal polishing head.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

To facilitate understanding, identical reference numerals have been used, where possible, to designate identical elements that are common to the figures. Herein, an applied eccentric motion is equivalent to a cylindrical offset and the two phrases may be used interchangeably.

DETAILED DESCRIPTION OF THE INVENTION

The disclosed invention provides motion in two separate directions within a polishing tool, thereby allowing greater velocity and subsequent oscillation frequency. The present invention incorporates radial and axial offset components within the polishing tool itself, thereby creating simultaneous motion in two perpendicular planes at the point of contact during pure rotation of the polishing tool. The present invention is exceptionally well-suited to sub-aperture polishing.

Figure 1:
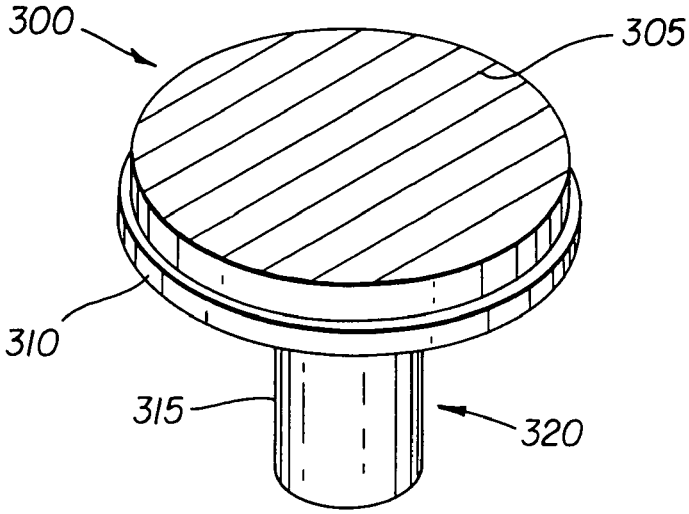
FIG. 1 (Prior Art)
FIG. 1 is an isometric view of a prior art polishing tool.
Figure 2:
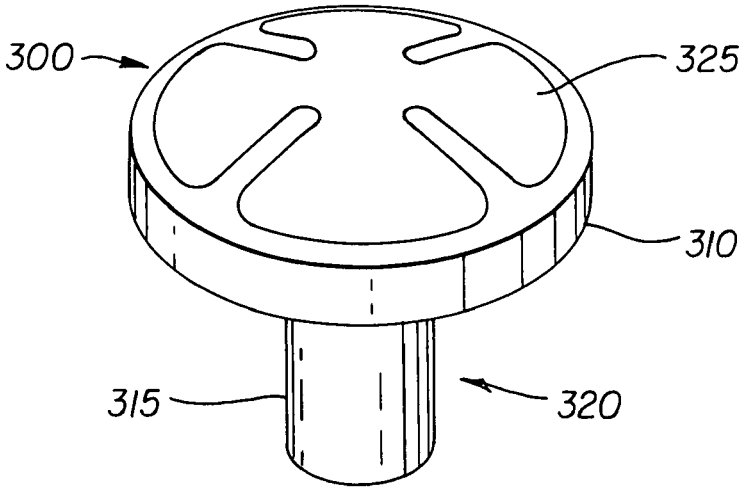
FIG. 2 (Prior Art)
FIG. 2 is an isometric view of a prior art polishing tool with a polishing pad.
Figure 3:
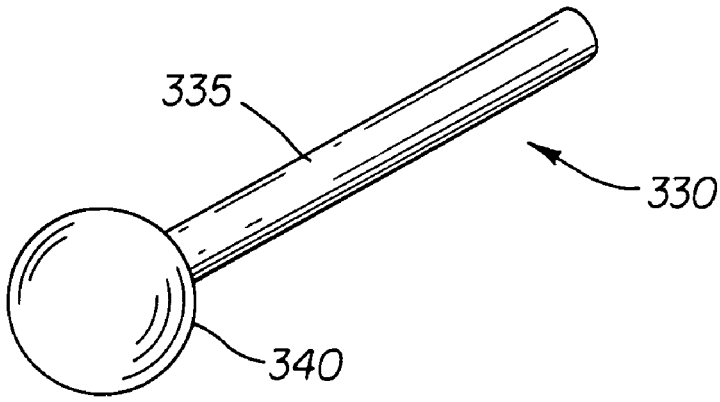
FIG. 3 (Prior Art)
FIG. 3 is an isometric view of a prior art sub-aperture polishing tool with a spherical polishing head.
Figure 4:
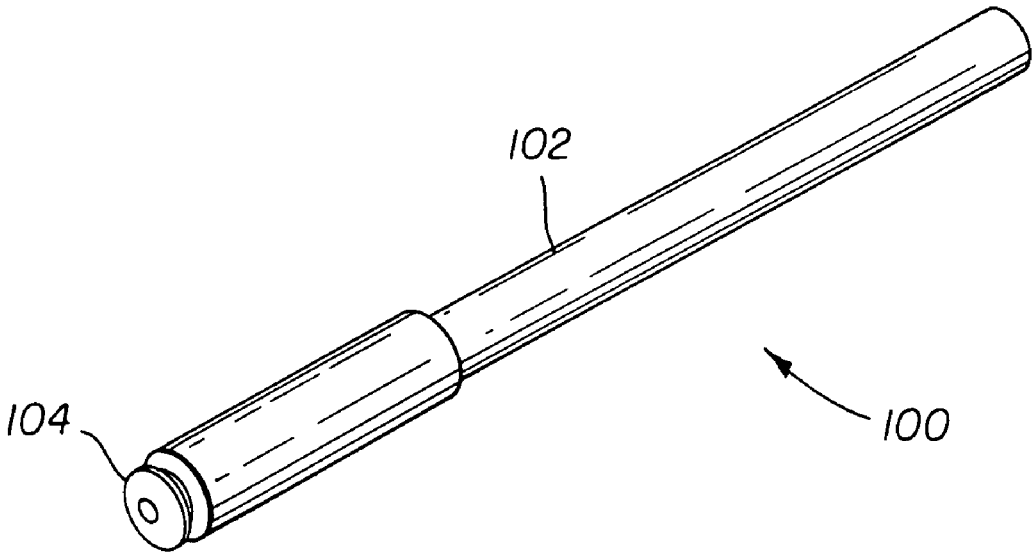
FIG. 4 is an isometric view of one embodiment of the invention, e.g., a dual motion polishing tool assembly with toroidal polishing tip.

As illustrated in FIG. 4, one embodiment of a dual motion polishing tool 100 includes two parts, (i) an arbor 102 and (ii) a toroidal polishing tip 104. Polishing tool 100 provides an advantageous dual motion polishing, i.e., simultaneous motion in two perpendicular planes at the point of contact during pure rotation of the polishing tool 100. The arbor 102 fixedly attached to polishing tool 100 facilitates the dual motion polishing.

Figure 5:
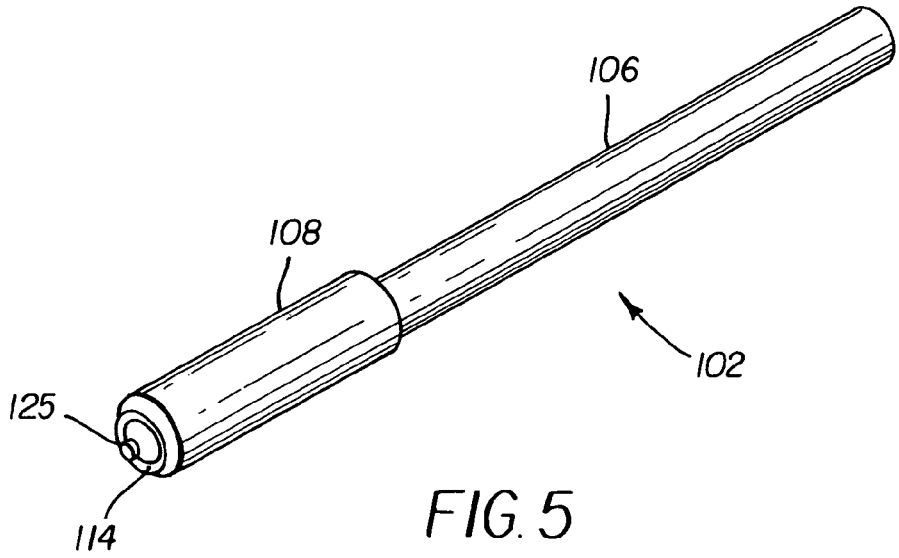
FIG. 5 is an isometric view of the dual motion polishing tool arbor.
Figure 6:
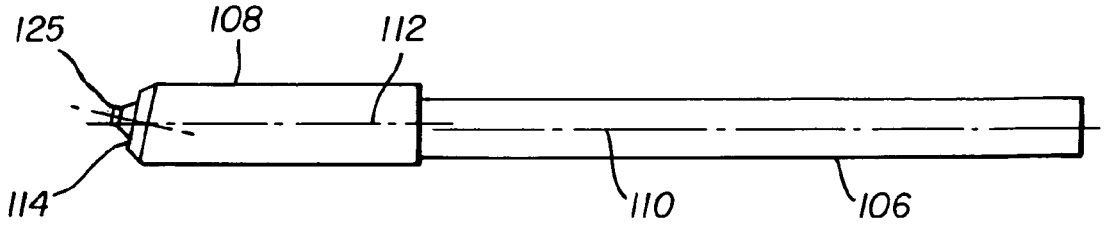
FIG. 6 is a plane view of the dual motion polishing tool arbor.
Figure 7:
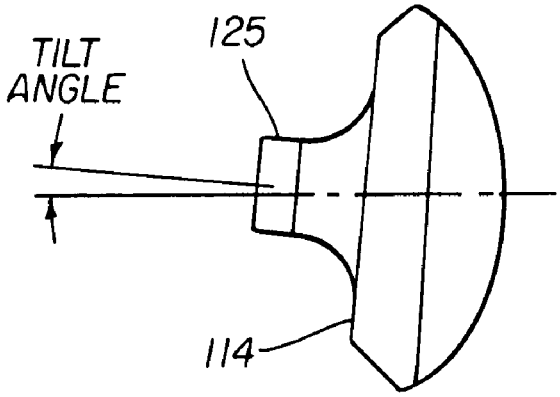
FIG. 7 is a close up view of the distal end of the dual motion polishing tool arbor showing the tilt angle.

Referring to FIG. 5, the arbor 102 is constructed as a shank 106 that is inserted into a drive unit (not shown). Arbor 102 also includes an offset cylinder 108 that encompasses a portion of shank 106 and has a distal end 114. Upon distal end 114 a centering boss 125 may be added which aids in providing concentric alignment of toroidal polishing tip 104 during attachment. Arbor 102 may be manufactured as a single piece, wherein offset cylinder 108 extends from shank 106. The construction of the arbor 102 is most efficiently done by a turning process upon a solid piece of metal to form the shank 106 and the offset cylinder 108. A four jaw chuck may be employed in the turning process. Consequently, the eccentric motion is built into the arbor 102. In one embodiment of the invention, as illustrated in FIG. 6, an axis 110 of shank 106 is offset from an axis 112 of offset cylinder 108. The two offset axes 110 and 112 provide an eccentric motion to the polishing tool 100 as it rotates. The distal end 114 of offset cylinder 108 is machined to provide a tilt that is in-line with the direction of offset as shown in FIGS. 6 and 7. The tilt angle can be about 1° to about 20°. If provided, centering boss 125 projects normally from the tilted support surface. A toroidal polishing tip 104 of toroidal geometry is then attached centrally to tilted distal end 114, whereby the toroidal polishing tip 104 itself is concentric with the tilted diameter of the distal end 114. The toroidal polishing tip 104 may have an alignment port 126 (shown in FIG. 10) concentric with its outside diameter, intended to mate with centering boss 125 if provided on arbor 102 to provide concentric alignment and to aid in attachment. Attachment of the toroidal polishing tip 104 to the arbor 102 may be accomplished in a variety of ways including adhesive, chemical, thermal, or mechanical bonding.

Figure 8:
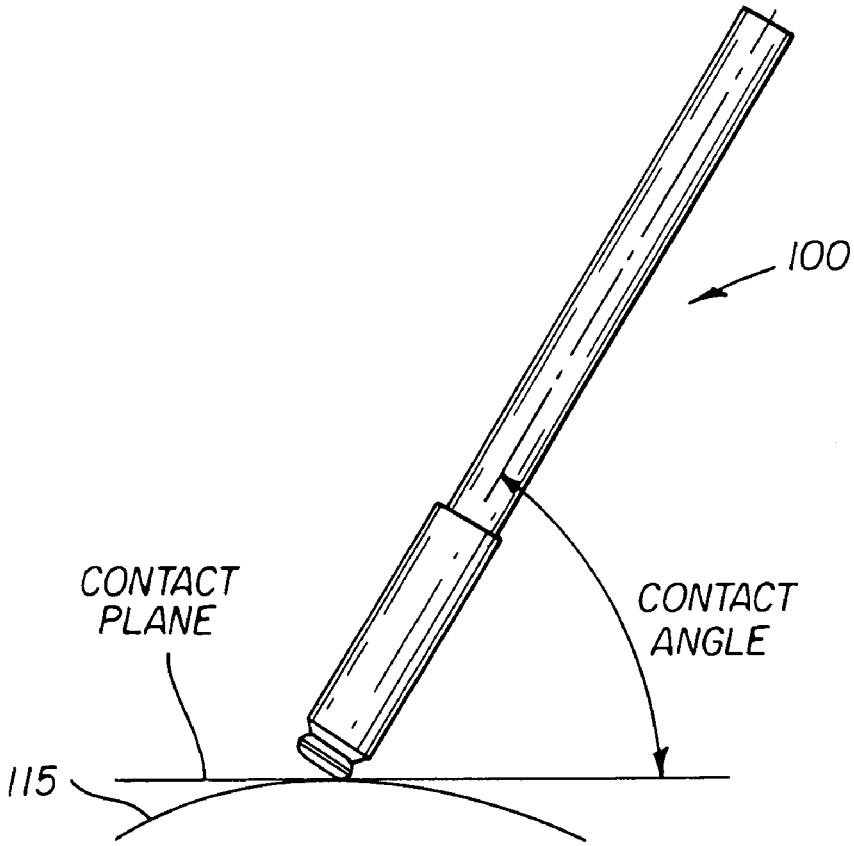
FIG. 8 is a plane view of the dual motion polishing tool in contact with a contact plane showing the contact angle.

The amount of tilt and offset required is determined by two factors. One being the angle of inclination, herein, referred to as the contact angle, (typically about 15° to about 45°) of the polishing tool 100 with respect to the work piece surface 115, as shown in FIG. 8. The second factor is the desired amount of oscillation in the plane of contact. The first factor, contact angle, is chosen to provide productive surface speeds for material removal during polishing while allowing the greatest range of tool movement. The second factor, oscillation in the contact plane, is dependent on the size and configuration of the toroidal polishing tip 104 and the amount of eccentric required to provide uniform contact during rotation for the given tilt angle.

In yet another embodiment, the dual motion polishing tool 100, as described, would be mounted in a device (not shown) intended to provide purely rotary motion, such as a standard drill motor, high speed spindle, and the like. The high speed spindle can have speeds that range from 2,000–40,000 rpm. These speeds may be controlled to go as high as 80,000 rpm with an air-driven turbine. Activation of the drill motor would cause dual motion polishing tool 100 to spin, which due to the dual motion polishing tool's unique geometry, would cause the toroidal polishing tip 104 to oscillate in an eccentric fashion about the axial centerline of the arbor 102. The dual motion polishing tool 100 would then be brought close to a work piece surface to be polished, while tilted at a predetermined contact angle that deviates from surface normal, thereby allowing increased productive material removal. As the dual motion polishing tool 100 makes contact with the work piece surface 115 (shown in FIG. 8), due to the eccentric offset and tilt provided, the contact area created will be uniform and moves laterally back and forth along the work piece surface 115 in the contact plane. The magnitude of oscillation is dependent upon the magnitudes of eccentric offset and tilt angle.

Figure 9:
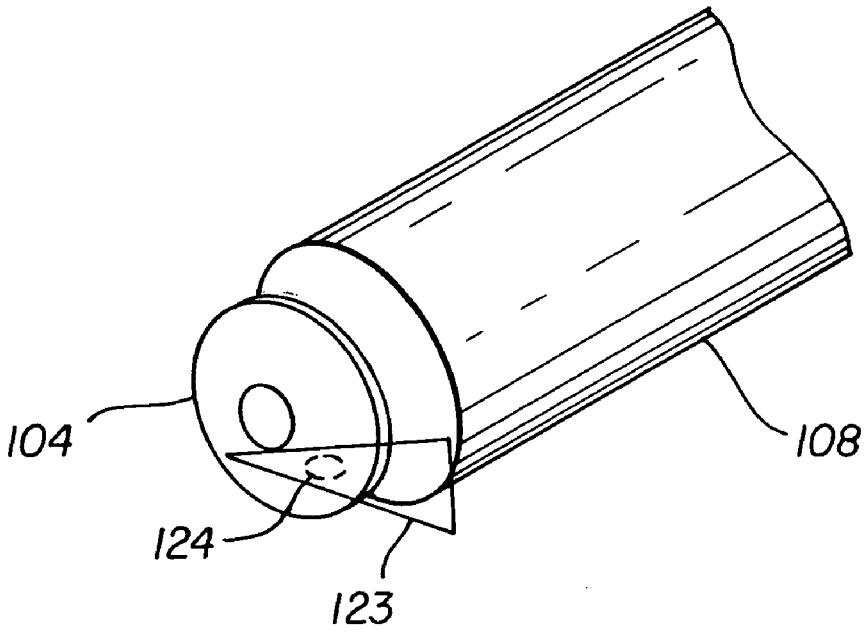
FIG. 9 is a close up view of the distal end of the dual motion polishing tool showing a toroidal polishing tip with a single transparent wedge representing a 30-degree contact plane.

FIG. 9 illustrates a contact patch 124 formed by the intersection of toroidal polishing tip 104 and the work piece surface 115, as represented by a transparent wedge 123. The contact patch 124 is shown inside the transparent wedge 123 that represents the contact plane described above. One skilled in the art should note that motion may be described relevant to the contact plane. For example, an in-plane motion is within the contact plane; whereas an out-of-plane motion occurs perpendicular to the contact plane. The toroidal polishing tip's 104 magnitude of oscillation in-plane and out-of-plane may be approximated using the following equations:

In-plane:

$$X = \left[\left(\frac{D_{CS}}{2} + \frac{D_{ID}}{2}\right)\Big/\cos(\beta) + \left(\frac{D_{CS}}{2}\sin(\alpha - \beta\cos(\theta))\right)\Big/\cos(\beta) + \left(\frac{D_{CS}}{2}\left[1 + \cos(\alpha - \beta\cos(\theta)\right]\tan(\theta)\right)\cos(\beta)\cos(\theta) + (Ecc)\cos(\theta)\right]\Big/\cos(\alpha) \quad \text{(Equation 1)}$$

Out-of-plane:

$$Y = \frac{D_{CS}}{2} + \left[\left\{\frac{Ecc}{\cos(\beta)}\sin(\alpha - \beta\cos(\theta)\right\}\cos(\theta)\right] + \left[\left\{\frac{D_{CS}}{2} + \frac{D_{ID}}{2}\right\}\sin(\alpha - \beta\cos(\theta)\right] + \left[\frac{D_{CS}}{2}\cos(\alpha - \beta\cos(\theta)\right] \quad \text{(Equation 2)}$$

Figure 10:
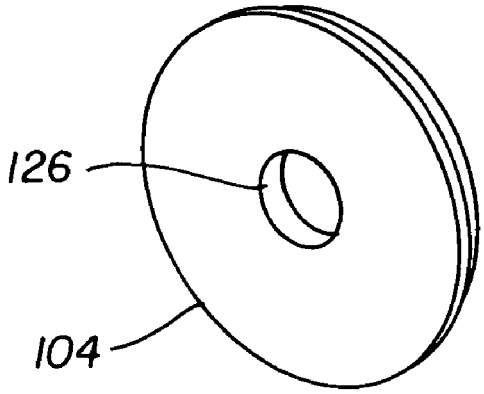
FIG. 10 is a close up view of the toroidal polishing tip.

Where, $D_{CS}$ and $D_{ID}$ are the cross-sectional diameter and internal diameter of the toroidal polishing tip 104, respectively. Alpha, α, is the contact angle, Beta, β, is the tilt angle, and Theta, θ, is the rotation angle. Ecc is the value of the eccentric. FIG. 10 shows a close isometric view of the toroidal polishing tip 104 with the alignment port 126. The toroidal polishing tip 104 is about 1–3 mm in diameter and can be constructed of Buna-N Nitrile, Ethylene Propylene, Silicone, Neoprene, or Polyurethane for greater material removal efficiency.

Figure 11:
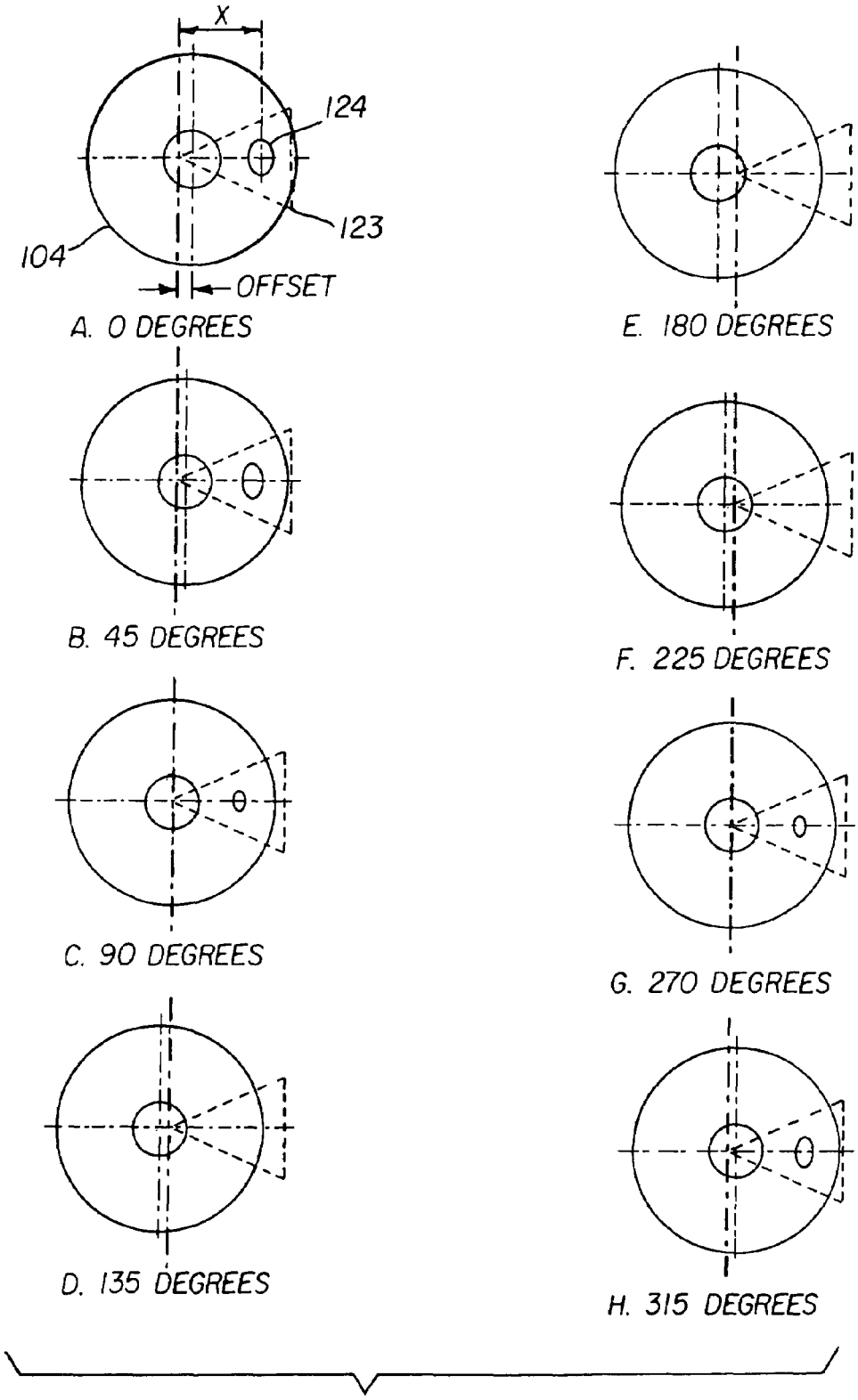
FIG. 11 is a series of eight front views of a conventional sub-aperture polishing tool with an applied eccentric showing a toroidal polishing tip engagement (represented by an oval contact area) with contact plane (represented by a transparent wedge) throughout eight 45-degree rotations of the polishing tool.

FIG. 11 discloses a front view of a conventional sub-aperture polishing tool 330 with an applied eccentric and the contact plane represented by a transparent wedge 123. The use of a transparent wedge 123 in the representation allows one to actually see the contact patch 124 created by the area of interface between toroidal polishing tip 104 and work piece surface 115 (shown here as the contact plane represented by a transparent wedge 123). Indexes A through H, in FIG. 11 provide a representation of contact for a given rotation of the sub-aperture polishing tool 330. For all indexes, the leftmost corner of the transparent wedge 123 is coincident with a point at the intersection of the shank axis 110 and a 30-degree contact plane. For clarification, a bold vertical axis is created at this intersection. Index A represents the initial start point (0 degrees) as the sub-aperture polishing tool 330 is engaged with the work piece surface 115 creating a contact patch 124. The in-plane distance, X, between the bold vertical axis and the center of the contact patch 124 is at its maximum at this index. Due to the cylindrical-axis offset, maximum compression of the toroidal polishing tip 104 is also observed at this index. The compression of the toroidal polishing tip 104 is represented by the contact patch size. Variation in contact patch size provides a graphical representation of the out-of-plane motion. As the sub-aperture polishing tool 330 rotates 45 degrees, represented by index B, the toroidal polishing tip 104 translates to the left and compression of the toroidal polishing tip 104 is reduced, showing a reduction in contact patch size. Index C shows an additional 45 degrees of rotation of the sub-aperture polishing tool 330, where a further reduction of the contact patch size is observed as the toroidal polishing tip 104 translates further left. Another 45 degrees of rotation (Index D) shows no contact patch, indicating the toroidal polishing tip 104 is no longer in contact with the work piece surface 115. Translation of the toroidal polishing tip 104 continues to the left until 180 degrees rotation of the sub-aperture tool 330 has been made (Index E). At index E, the in-plane distance, X, is at its minimum. Due to the cylindrical-axis offset, minimum compression of the toroidal polishing tip 104 is also observed at this index (for this case, the toroidal polishing tip 104 is at its peak distance off the work piece surface 115). Beyond this index, continued rotation begins to mirror observations made during the previous rotational steps. An additional 45 degree rotation of the sub-aperture polishing tool 330 begins to translate the toroidal polishing tip 104 to the right (Index F at 225 degrees). No observation of the contact patch is made, indicating the toroidal polishing tip 104 is still off the work piece surface 115. Observations for Index F and index D are the same. Observations of the contact patch size for index G at 270 degrees and index H at 315 degrees are the same for index C at 90 degrees and index B at 45 degrees, respectively. The only difference being that the contact patch moves from right-to-left during indexes A to E and from left-to-right during indexes E to H. FIG. 11 shows that in one embodiment, if no support surface tilt is applied, intermittent contact is observed (i.e., using a polishing tool with toroidal polishing tip 104 with a cylindrical axis offset only).

Figure 12:
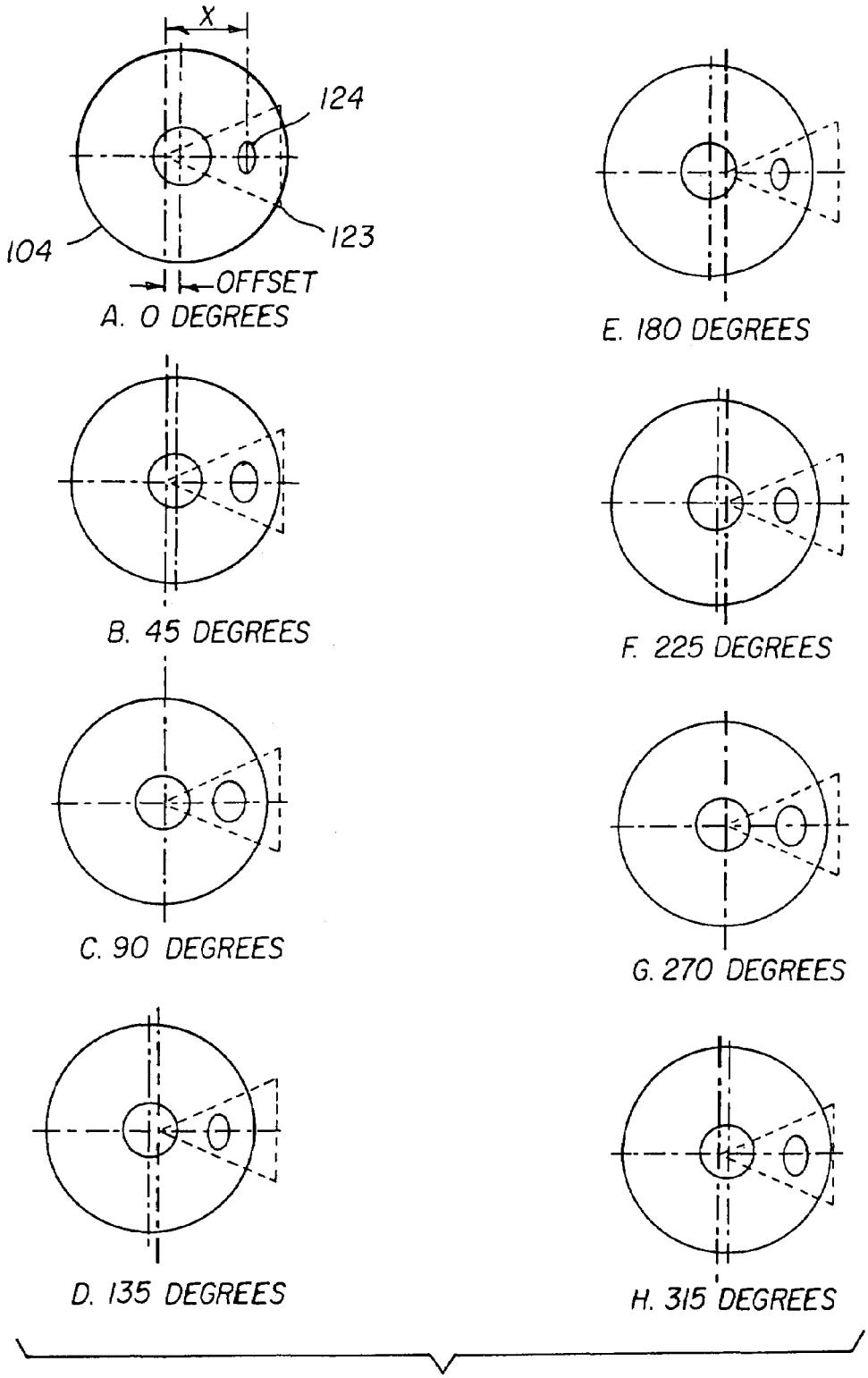
FIG. 12 is a series of eight front views of the dual motion polishing tool showing a toroidal polishing tip engagement (represented by an oval contact area) with contact plane (represented by a transparent wedge) throughout eight 45-degree rotations of the polishing tool.

FIG. 12 discloses a front view of the dual motion polishing tool 100 with the contact plane represented by the transparent wedge 123. The use of the transparent wedge 123 in the representation allows one to actually see the contact patch 124 created by the area of interface between toroidal polishing tip 104 and work piece surface 115 (shown here as the contact plane represented by a transparent wedge 123). Indexes A through H, in FIG. 12 provide a representation of contact for a given rotation of the dual motion polishing tool 100. For all indexes, the leftmost corner of the transparent wedge 123 is coincident with a point at the intersection of the shank axis 110 and a 30-degree contact plane. For clarification, a bold vertical axis is created at this intersection. Index A represents the initial start point (0 degrees) as the dual motion polishing tool 100 is engaged with the work piece surface creating a contact patch 124. The in-plane distance, X, between the bold vertical axis and the center of the contact patch 124 is at its maximum at this index. The compression of the toroidal polishing tip 104 at this index is at a minimum value. The compression of the toroidal polishing tip 104 is represented by the contact patch size. Variation in contact patch size provides a graphical representation of the out-of-plane motion. As the tool rotates 45 degrees, represented by index B, the toroidal polishing tip 104 translates to the left and compression of the toroidal polishing tip 104 is increased, showing an enlargement in contact patch size. Index C shows an additional 45 degrees of rotation of the dual motion polishing tool 100, where a further enlargement of the contact patch size is observed as the toroidal polishing tip 104 translates further left. At this index (index C at 90 degrees) compression of the toroidal polishing tip 104 reaches a maximum, due to the unique combination of the cylindrical-axis offset and support surface tilt. Another 45 degrees of rotation (Index D) continues contact patch translation to the left while the size of the contact patch begins to reduce, indicating a reduction in compression. Translation of the toroidal polishing tip 104 continues to the left until 180 degrees rotation of the tool has been made (Index E). At index E, the in-plane distance, X, is at its minimum. Also, the compression of the toroidal polishing tip 104 at this index is again at a minimum value. Beyond this index, continued rotation begins to mirror observations made during the previous rotational steps. An additional 45 degree rotation of the dual motion polishing tool 100 begins to translate the toroidal polishing tip 104 to the right (Index F at 225 degrees). Observations of the contact patch size for index F at 225 degrees, G at 270 degrees, and index H at 315 degrees are the same for index D at 135 degrees, index C at 90 degrees, and index B at 45 degrees, respectively. The only difference being that the contact patch moves from right-to-left during indexes A to E and from left-to-right during indexes E to H, creating the in-plane distance, X, oscillation. In this embodiment, FIG. 12 shows that with the addition of a slight support surface tilt in the direction of cylindrical axis offset (provided by the dual motion polishing tool 100) continuous contact is observed and a slight oscillation of the contact area is achieved. In order to increase oscillation magnitude while maintaining continuous contact with the surface being polished, support surface tilt angle and cylindrical axis offset should, preferably, be increased together. For small oscillation magnitudes (shallow tilt angles), surface oscillation occurs primarily in the contact plane or zone. As the magnitude of surface oscillation is increased, larger surface support tilt angles and cylindrical axis offsets are required and result in a component of oscillation that moves in and out of the contact plane. One revolution of the rotating dual motion polishing tool 100 provides a single back-and-forth oscillation of the contact patch 124. The distance in the contact plane covered in this motion by the contact patch 124 is equivalent to approximately twice the magnitude of the cylindrical axis offset.

The dual motion polishing tool 100 disclosed is preferably used in the presence of a free-abrasive liquid lap such as cerium oxide, chromium oxide, colloidal silica, diamond suspension, and the like. Free-abrasive liquid is chosen based on the material being polished, the desired level of surface smoothness, and on the mechanism of removal being pursued and corresponding efficiency. For glasses, chemical-mechanical polishing is the most efficient mechanism for polishing and an oxidant such as cerium oxide is typically used. Presently, diamond suspension is chosen for ceramics. As the dual motion polishing tool 100 rotates, the liquid lap is carried on the toroidal polishing tip 104 via laminar boundary layer flow. The polishing fluid travels along the outside of the toroidal polishing tip 104 and is carried into the contact region between the toroidal polishing tip 104 and the work piece surface 115. The motion that is provided by the dual motion polishing tool 100 allows advantageous bi-directional polishing.

Bi-directional polishing, is defined by the motions created as the tool oscillates during rotation, thus allowing the polishing fluid to deviate from straight-line motion reducing potential grooving of the work piece surface.

The invention has been described with reference to a preferred embodiment; However, it will be appreciated that variations and modifications can be effected by a person of ordinary skill in the art without departing from the scope of the invention.

PARTS LIST

100 dual motion polishing tool
102 arbor
104 toroidal polishing tip
106 shank
108 offset cylinder
110 shank axis
112 offset cylinder axis
114 distal end of offset cylinder 108
115 work piece surface
123 transparent wedge
124 contact patch
125 centering boss
126 alignment port
300 polishing tool
305 grooves
310 support surface
315 shank
320 arbor
325 polishing pad
330 sub-aperture polishing tool
335 sub-aperture arbor
340 sub-aperture polishing head

What is claimed is:

1. A polishing tool comprising:

a) an arbor that includes:

a1) a shank having a first cylindrical axis;

a2) an offset cylinder extending from the shank, the offset cylinder having a second cylindrical axis, the first cylindrical axis being offset from the second cylindrical axis and parallel thereto, the offset cylinder terminating at a distal end thereof with a support surface that is angled in a range of from about 1° to about 20° from perpendicular to the first and second cylindrical axes; and b) a toroidal polishing head supported on the support surface, rotation of the shank causing an oscillating rotational movement of the toroidal polishing head; wherein the oscillating rotational movement of the toroidal polishing head includes an in-plane motion to alleviate grooves and an out-plane motion for facilitating polishing liquid transfer between the toroidal polishing head and a work piece surface; and wherein the in-plane motion of the oscillating rotational movement of the toroidal polishing head is described by:

$$X = \left[\left(\frac{D_{CS}}{2} + \frac{D_{ID}}{2}\right)\Big/\cos(\beta) + \left(\frac{D_{CS}}{2}\sin(\alpha - \beta\cos(\theta))\right)\Big/\cos(\beta) + \left(\frac{D_{CS}}{2}\left[1 + \cos(\alpha - \beta\cos(\theta)\right]\tan(\theta)\right)\cos(\beta)\cos(\theta) + (Ecc)\cos(\theta)\right]\Big/\cos(\alpha).$$

2. The polishing tool as recited in claim 1, further comprising:

(c) a centering boss projecting normal from the support surface having a third cylindrical axis coincident with a point determined by intersecting the support surface and the second cylindrical axis; and (d) an alignment port in the toroidal polishing head, the alignment port capable of receiving the centering boss.

3. A polishing tool comprising:

a) an arbor that include;

a1) a shank having a first cylindrical axis;

a2) an offset cylinder extending from the shank, the offset cylinder having a second cylindrical axis, the first cylindrical axis being offset from the second cylindrical axis and parallel thereto, the offset cylinder terminating at a distal end thereof with a support surface that is angled in a range of from about 1° to about 20° from perpendicular to the first and second cylindrical axes; and b) a toroidal polishing head supported on the support surface, rotation of the shank causing an oscillating rotational movement of the toroidal polishing head; wherein the oscillating rotational movement of the toroidal polishing head includes an in-plane motion to alleviate grooves and an out-plane motion for facilitating polishing liquid transfer between the toroidal polishing head and a work piece surface; and wherein the out-plane motion of the oscillating rotational movement of the toroidal polishing head is described by:

$$Y = \frac{D_{CS}}{2} + \left[\left\{\frac{Ecc}{\cos(\beta)}\sin(\alpha - \beta\cos(\theta)\right\}\cos(\theta)\right] + \left[\left\{\frac{D_{CS}}{2} + \frac{D_{ID}}{2}\right\}\sin(\alpha - \beta\cos(\theta)\right] + \left[\frac{D_{CS}}{2}\cos(\alpha - \beta\cos(\theta)\right].$$

* * * * *